US011646481B2

(12) United States Patent
Yoo et al.

(10) Patent No.: US 11,646,481 B2
(45) Date of Patent: May 9, 2023

(54) MULTIPLE INPUT MULTIPLE OUTPUT ANTENNA APPARATUS

(71) Applicant: KMW INC., Hwaseong-si (KR)

(72) Inventors: Chang Woo Yoo, Suwon-si (KR); In Ho Kim, Yongin-si (KR); Min Sik Park, Hwaseong-si (KR); Hye Yeon Kim, Gangjin-gun (KR)

(73) Assignee: KMW INC., Hwaseong-si (KR)

( * ) Notice: Subject to any disclaimer, the term of this patent is extended or adjusted under 35 U.S.C. 154(b) by 844 days.

(21) Appl. No.: 16/656,589

(22) Filed: Oct. 18, 2019

(65) Prior Publication Data

US 2020/0052363 A1 Feb. 13, 2020

Related U.S. Application Data

(63) Continuation of application No. PCT/KR2018/004638, filed on Apr. 20, 2018.

(30) Foreign Application Priority Data

Apr. 21, 2017 (KR) ..... 10-2017-0051475
Apr. 20, 2018 (KR) ..... 10-2018-0045883

(51) Int. Cl.
*H01Q 1/02* (2006.01)
*H01Q 1/38* (2006.01)
*H01Q 21/00* (2006.01)

(52) U.S. Cl.
CPC ..... *H01Q 1/02* (2013.01); *H01Q 1/38* (2013.01); *H01Q 21/00* (2013.01)

(58) Field of Classification Search
CPC ..... H01Q 1/02; H01Q 21/00; H01Q 21/28
See application file for complete search history.

(56) References Cited

U.S. PATENT DOCUMENTS 5,917,703 A 6/1999 Murphy
8,125,078 B2 * 2/2012 Yoshida ..... H01L 23/473 257/712

(Continued)

FOREIGN PATENT DOCUMENTS

CN 103582393 A 2/2014
JP H06-188344 A 7/1994

(Continued)

OTHER PUBLICATIONS

Notice of Allowance dated Jun. 28, 2022 for Japanese Application No. 2021-132147.

(Continued)

*Primary Examiner* — Hoang V Nguyen
(74) *Attorney, Agent, or Firm* — Insight Law Group, PLLC; Seung Lee

(57) ABSTRACT

The present disclosure relates to an MIMO antenna apparatus, and in particular, includes a PCB having at least one heat-generation element provided on one surface thereof, a first heat-dissipation part disposed to cover one surface of the PCB, having a through hole formed in a portion corresponding to the position provided with the heat-generation element, and having a plurality of vertical heat-dissipation fins formed to be extended in a direction perpendicular to the outside surface thereof, and a second heat-dissipation part detachably coupled to the through hole to contact one surface of the heat-generation element to receive heat from the heat-generation element and to dissipate heat at a long distance father than the first heat-dissipation part, thereby enhancing heat-dissipation performance and expanding universality of a product.

18 Claims, 11 Drawing Sheets

(56) References Cited

U.S. PATENT DOCUMENTS

| | | | |
|---|---|---|---|
| 2008/0037226 | A1 | 2/2008 | Shin et al. |
| 2010/0008045 | A1 | 1/2010 | Xu |

FOREIGN PATENT DOCUMENTS

| | | | |
|---|---|---|---|
| JP | H09-289329 | A | 11/1997 |
| JP | 2002-008923 | A | 1/2002 |
| JP | 2002-513217 | A | 5/2002 |
| JP | 2007-080989 | A | 3/2007 |
| JP | 2012-521657 | A | 9/2012 |
| JP | 2013-143488 | A | 7/2013 |
| JP | 2013-162052 | A | 8/2013 |
| JP | 2017-046121 | A | 3/2017 |
| JP | 2017-228748 | A | 12/2017 |
| KR | 10-1439045 | B1 | 9/2014 |
| KR | 10-1567363 | B1 | 11/2015 |

OTHER PUBLICATIONS

International Search Report for PCT/KR2018/004638, dated Jul. 30, 2018, and its English translation.

* cited by examiner

MULTIPLE INPUT MULTIPLE OUTPUT ANTENNA APPARATUS

CROSS-REFERENCE TO RELATED APPLICATION

This application is a Continuation of International Application No. PCT/KR2018/004638, filed on Apr. 20, 2018, which claims the benefit of and priority to Korean Patent Application Nos. 10-2017-0051475, filed on Apr. 21, 2017 and 10-2018-0045883, filed on Apr. 20, 2018, the content of which are herein incorporated by reference in their entirety.

TECHNICAL FIELD

The present disclosure relates to an MIMO antenna apparatus, and more particularly, to an MIMO antenna apparatus, which may directly contact a heat-generation element for generating heat, thereby enhancing heat-dissipation performance, and eliminate assembling tolerance and height deviation with a peripheral component, thereby enhancing universality.

BACKGROUND ART

A wireless communication technology, for example, a Multiple Input Multiple Output (MIMO) technology, as a technology of significantly increasing the data transmission capacity by using a plurality of antennas, is a Spatial multiplexing technique in which a transmitter transmits different data from each other through each transmission antenna, and a receiver distinguishes the transmitted data through a proper signal processing.

Accordingly, as the number of transmission/reception antennas increases at the same time, the channel capacity may increase to allow more data to be transmitted. For example, it is possible to secure about 10 times the channel capacity by using the same frequency band compared to the current single antenna system if it is required to increase the number of antennas to 10.

In the case of a transceiver to which the Multiple Input Multiple Output (MIMO) technology has been applied, as the number of antennas increases, the number of transmitters and filters also increases, a predetermined heat is generated by the high output for expanding the coverage, and the external emission of the generated heat has a great impact on durability and antenna performance of the product. This heat-dissipation problem may be recognized as a common problem occurring in both a communication component mounted in a PCB and a heat-generation element for generating a predetermined heat.

Conventionally, a structure has been general in which one surface of a heat-dissipation body provided with a plurality of heat-dissipation fins indirectly contacts the heat-generation element by using a medium such as a thermal pad, and the heat generated from the heat-generation element is heat-dissipated to the outside through the heat-dissipation fin of the heat-dissipation body.

As described later, the thermal pad inevitably generates contact thermal resistance. Nevertheless, the reason why the thermal pad is provided to mediate between the heat-generation element and the heat-dissipation body is for allowing the heat-dissipation body to easily deliver the heat while eliminating the assembling tolerance necessary for installing to contact the heat-generation element of the PCB, the height deviation generated during soldering of the heat-generation element to the PCB, and the like.

However, the heat-dissipation structure according to the related art has had the difficulty in efficiently cooling the component by inevitably generating the contact thermal resistance between the heat-generation element and the heat-dissipation body by the thermal pad having a certain thickness, has had a problem of further increasing the contact thermal resistance in the case of increasing the thickness of the thermal pad in order to eliminate the above-described assembling tolerance, the height deviation, and the like, and in order to solve this problem, it is possible to change the design to increase the height of the heat-dissipation fin of the heat-dissipation body but a problem that increases the weight and size of the product is additionally caused by the design change, and in particular, there is a problem that reaches the saturation state where the component temperature does not lower even if the height of the heat-dissipation fin of the heat-dissipation body increases if the heat-generation amount is high.

Meanwhile, as the related art in the art to which the present disclosure pertains, there is Korean Patent Laid-Open Publication No. 2012-0029632 that discloses the contents of the lamp apparatus capable of efficiently emitting heat generated at the time of driving the lamp apparatus.

DISCLOSURE

Technical Problem

The present disclosure is intended to solve the above problems, and an object of the present disclosure is to provide a Multiple Input Multiple Output (MIMO) antenna apparatus, which may directly contact a heat-dissipation part to heat-generation elements, thereby enhancing heat-dissipation performance, and eliminate assembling tolerance and height deviation with a peripheral component, thereby enhancing universality, in the Multiple Input Multiple Output (MIMO) antenna apparatus provided with a heat-generation element such as a plurality of antenna elements and a communication component for electrically connecting them.

Technical Solution

A preferred embodiment of an MIMO antenna apparatus according to the present disclosure includes a PCB having at least one heat-generation element provided on one surface thereof, a first heat-dissipation part disposed to cover one surface of the PCB, having a through hole formed in a portion corresponding to the position provided with the heat-generation element, and having a plurality of vertical heat-dissipation fins formed to be extended in a direction perpendicular to the outside surface thereof, and a second heat-dissipation part detachably coupled to the through hole to contact one surface of the heat-generation element to receive heat from the heat-generation element and to dissipate heat at a long distance father than the first heat-dissipation part.

Here, the second heat-dissipation part may include a coupling body having one end portion coupled to be accommodated in the through hole, and a plurality of vertical heat-dissipation fins extended and formed to be perpendicular to the plurality of vertical heat-dissipation fins on the outer circumferential surface of the coupling body.

Further, a heat distribution space cut axially toward one end portion thereof may be formed on the other end portion of the coupling body, and a heat distribution bridge extending upwards from the bottom surface of the heat distribution space and having the horizontal cross section of a "+" shape may be formed inside the heat distribution space.

Further, the coupled body may be formed with a plurality air vent holes communicating the heat distribution space with the outside, and penetrating between the plurality of horizontal heat-dissipation fins.

Further, a plurality of screw fastening holes may be formed on the rim portion of one surface forming one end portion of the coupling body, the through hole may be provided with a plurality of fastening flanges protruded to the inside and having a screw through hole formed therein, and the coupling body may be screw-coupled to the plurality of fastening flanges by a fastening screw.

Further, the coupling body may have the one surface moved to the side at which the heat-generation element has been provided upon the coupling of the fastening screw.

Further, a tolerance absorption ring closely contacting the plurality of fastening flanges, respectively, by the head portion of the fastening screw upon the coupling of the fastening screw may be interposed on the outer circumferential surface of the fastening screw.

Further, the tolerance absorption ring may be made of an elastic material.

Further, the PCB may be coupled to the first heat-dissipation part by a fastening member so that the heat-generation element faces the through hole, and the tolerance absorption ring may be elastically deformed when the coupling force of the PCB to the first heat-dissipation part by the fastening member is provided.

Further, a female thread may be formed on the inner circumferential surface of the through hole, and a male thread fastened to the female thread may be formed on the outer circumferential surface of the coupling body inserted into the through hole.

Further, a guide boss extending the through hole to the outside and guiding the insertion of one end portion of the coupling body may be formed to be protruded on the other surface of the first heat-dissipation part having the plurality of vertical heat-dissipation fins formed thereon, and a locking ring screw-coupled to closely contact the front end portion of the guide boss may be provided on the outer circumferential surface of the coupling body.

Further, a sealing member for blocking a gap between the inner circumferential surface of the guide boss and the coupling body may be interposed on the outer circumferential surface of the coupling body, and the locking ring may press the sealing member when closely contacting the front end portion of the guide boss.

Further, the second heat-dissipation part may further include a heat conductive medium block coupled to one surface of the coupling body, and contacting one surface of the heat-generation element, and the heat conductive medium block may be made of a material having a higher thermal conductivity than that of the coupling body.

Further, the heat conductive medium block may be coupled to a coupling groove formed in a groove shape on one surface of the coupling body in any one method of a screw coupling method and a forcibly press-fitting method.

Further, the heat conductive medium block may be coupled to one surface of the coupling body in any one method among a bonding coupling method, a brazing coupling method, and a heterogeneous injection molding method.

Further, the heat conductive medium material may be applied to one surface of the coupling body contacting the heat-generation element.

Further, the plurality of horizontal heat-dissipation fins may be arranged in plural in multiple stages to be spaced at a predetermined distance apart from each other from the heat-generation element to the outside, and the appearance combination of the plurality of horizontal heat-dissipation fins may be formed to have any one among cylindrical, hexahedral, sphere, and cone shapes.

Further, the MIMO antenna apparatus may further include an air baffle for blocking the heat dissipated from the second heat-dissipation part provided at the lower side relatively from being delivered to the second heat-dissipation part provided at the upper side relatively by the rising airflow, if the second heat-dissipation part is coupled, by one, to each of the upper side and the lower side of one surface of the first heat-dissipation part disposed vertically.

Advantageous Effects

According to an embodiment of the MIMO antenna apparatus according to the present disclosure, in the Multiple Input Multiple Output (MIMO) antenna apparatus provided with the heat-generation element such as the plurality of antenna elements and a communication component for electrically connecting them, it is possible to directly contact the heat-dissipation part to the heat-generation elements to drastically reduce the contact thermal resistance generated during the heat delivery, thereby enhancing the heat-dissipation performance and increasing the lifespan of the apparatus, and to eliminate the assembling tolerance and the height deviation with the peripheral component, thereby enhancing universality.

Further, according to an embodiment of the MIMO antenna apparatus according to the present disclosure, it is possible to directly contact the heat-dissipation part to each of the heat-generation elements of the PCB on which the plurality of communication components have been mounted to eliminate the signal distortion or signal imbalance phenomenon due to the high heat generated in the plurality of communication components, thereby greatly enhancing communication performance.

BEST MODE

Figure 1:
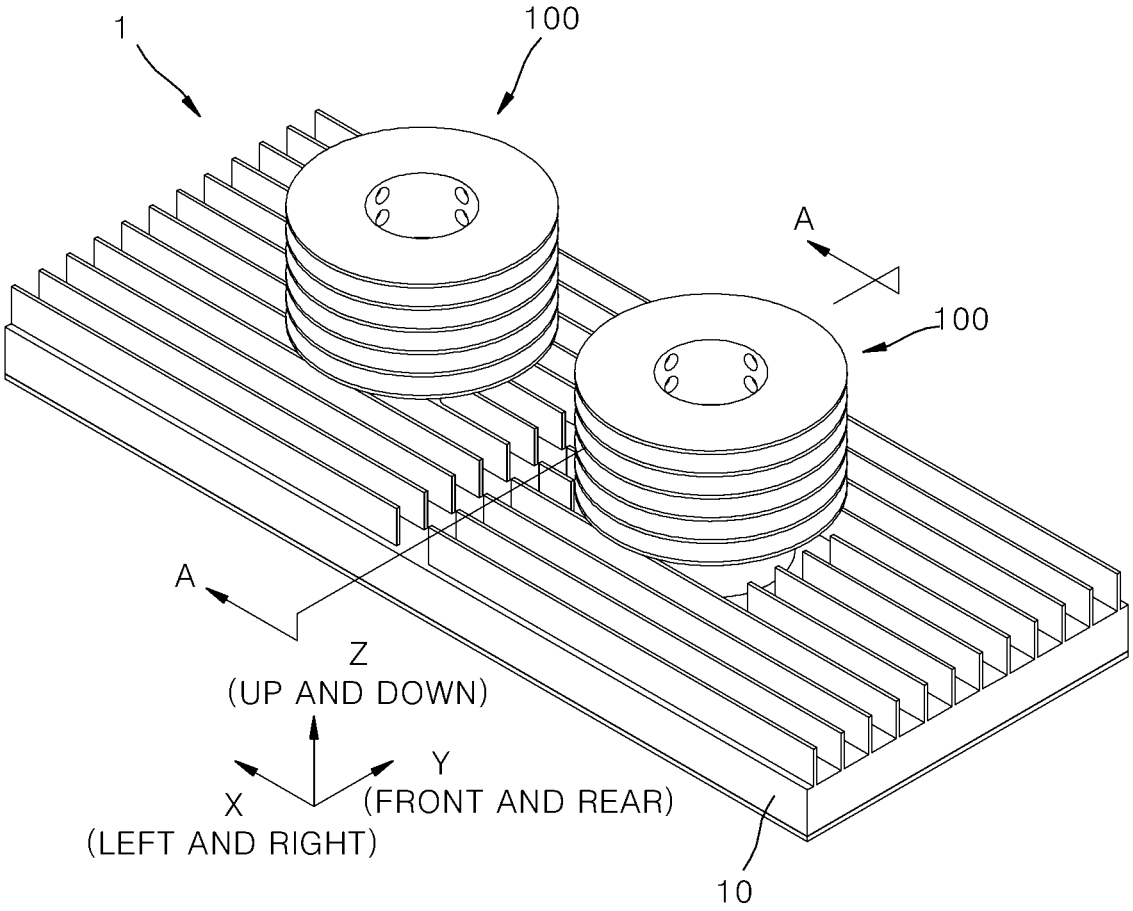
FIG. 1 is a perspective diagram illustrating a preferred embodiment of an MIMO antenna apparatus according to the present disclosure.

Advantages and features of the present disclosure, and a method for achieving them will be apparent with reference to the embodiments described below in detail with the accompanying drawings. However, the present disclosure is not limited to the embodiments disclosed below, but may be implemented in various different forms from each other, and only the present embodiments are provided to make the disclosure of the present disclosure complete, and to fully inform those skilled in the art to which the present disclosure pertains of the scope of the disclosure, and the present disclosure is defined only by the scope of the claims. The same components are denoted by the same reference numerals throughout the specification.

Hereinafter, an embodiment of an MIMO antenna apparatus according to the present disclosure will be described in detail with reference to the accompanying drawings.

Figure 2:
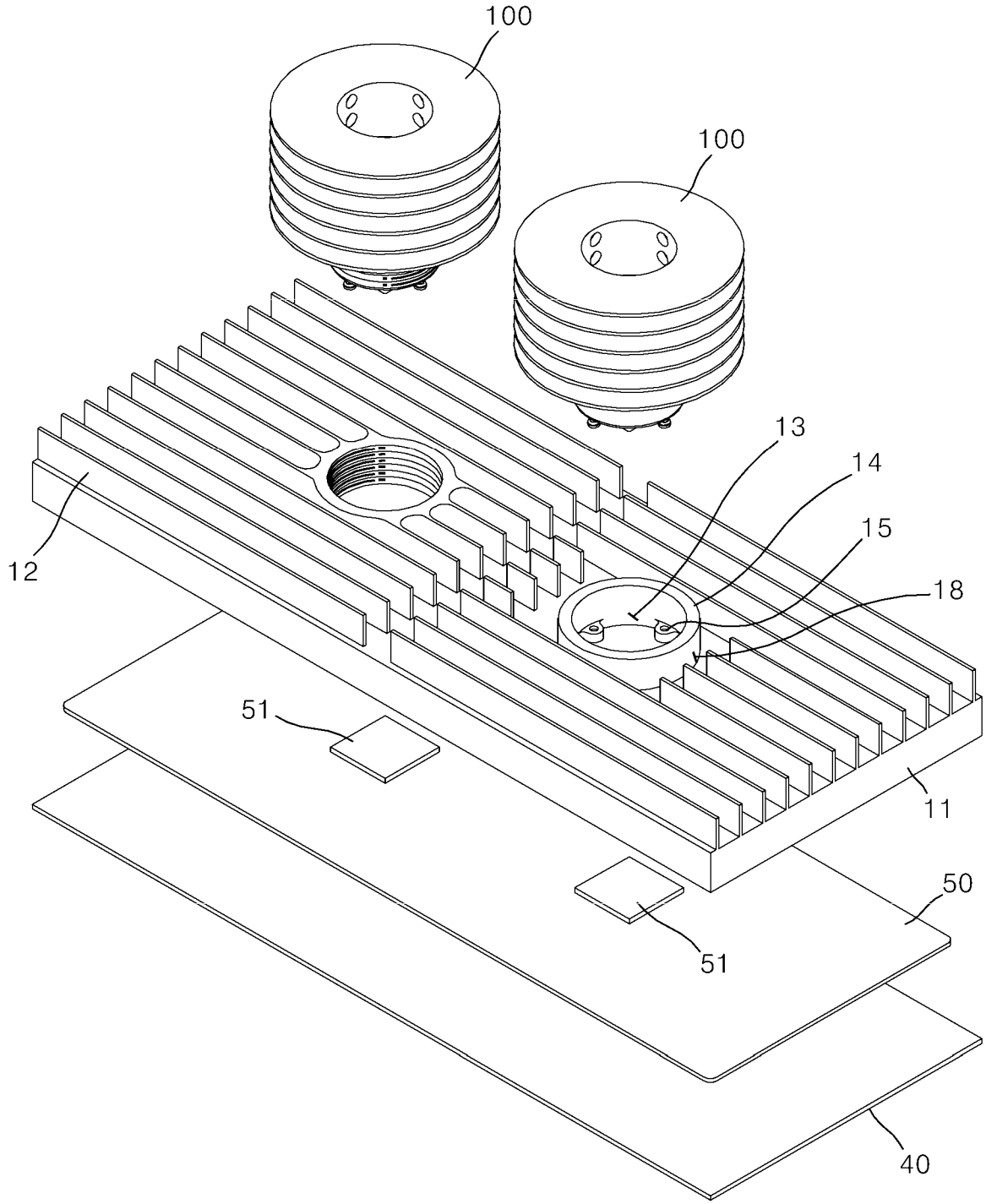
FIG. 2 is an exploded perspective diagram of FIG. 1.

FIG. 1 is a perspective diagram illustrating a preferred embodiment of an MIMO antenna apparatus according to the present disclosure, and FIG. 2 is an exploded perspective diagram of FIG. 1.

A preferred embodiment of the MIMO antenna apparatus 1 according to the present disclosure, as illustrated in FIGS. 1 and 2, includes a Printed Circuit Board (PCB) 50 having at least one heat-generation element 51 provided on one surface thereof, a first heat-dissipation part 10 disposed to cover one surface of the PCB 50, having a through hole 13 formed in a portion corresponding to the position provided with the heat-generation element 51, and having a plurality of vertical heat-dissipation fins 12 formed to be extended in a direction perpendicular to the outside surface thereof, and a second heat-dissipation part 100 detachably coupled to the through hole 13 to directly contact one surface of the heat-generation element 51 to receive heat from the heat-generation element 51 and dissipating heat at a long distance farther than the first heat-dissipation part 10.

Here, the heat-generation element 51 is a concept of including any element as long as it is an element that generates a predetermined heat while being driven by a power input. Specifically, communication components (for example, a transceiver, a filter, a Power Amplifier (PA), and the like) constituting a Multiple Input Multiple Output (MIMO) system capable of intensively constructing a fifth generation wireless communication technology by significantly increasing data transmission capacity by using a plurality of antennas may be a suitable example of a 'heat-generation element.'

Here, the MIMO system may be provided with a plurality of antenna elements, a digital processing circuit for controlling them, and a Power Supply Unit (PSU) provided to correspond to each to enable independent and individual control of each antenna element.

Meanwhile, as illustrated in FIG. 2, the first heat-dissipation part 10 has a predetermined thickness so that the PCB 50 is accommodated downwards in the figure, and includes a heat-dissipation part housing 11 that has a rectangular shape lengthily in one side and the other side direction, and has a rectangular parallelepiped shape having the lower surface opened in the figure. Hereinafter, for convenience of description, the lower portion of the first heat-dissipation part 10 in the figure is referred to as a 'PCB accommodation space 5 (illustrated in FIG. 4).'

Here, the PCB 50 may be coupled to closely contact the inside surface of the PCB accommodation space 5 by the coupling force of a fastening member not illustrated. For example, the fastening member may be a fastening screw coupled to a fastening hole not illustrated formed on the inside surface of the PCB accommodation space 5, and the PCB 50 may firmly, closely contact the inside surface of the PCB accommodation space 5 by the coupling force generated when the fastening screw is fastened to the fastening hole while penetrating the PCB 50.

The above-described vertical heat-dissipation fin 12 is protruded to the outside, formed lengthily in the longitudinal direction, and multiple ones are disposed in parallel to be spaced at a predetermined distance apart from each other in the width direction perpendicular to the longitudinal direction in the figure on the upper surface of the heat-dissipation part housing 11 corresponding to the upper side in the figure.

Further, at least one through hole 13 communicating with the PCB accommodation space 5 may be formed on the upper surface of the heat-dissipation part housing 11. A guide boss 14 may be formed on the upper surface of the heat-dissipation part housing 11 to be protruded upwards to extend the circumferential portion of the through hole 13.

The guide boss 14 extends a predetermined length upwards from the upper surface of the heat-dissipation part housing 11, is formed in a hollow cylindrical shape, has a shape with the through hole 13 extending upwards, and serves as a guide when the lower end portion of the second heat-dissipation part 100 is accommodated and coupled thereto in FIGS. 1 and 2.

Here, the upper end of the guide boss 14 may be formed to match the height of the plurality of vertical heat-dissipation fins 12 provided on the upper surface of the heat-dissipation part housing 11.

Further, as illustrated in the right portion in FIG. 2, a cutout part 18 in which a portion of the adjacent plurality of vertical heat-dissipation fins 12 has been cut to be spaced apart from the guide boss 14 may be formed around the guide boss 14.

However, the cutout part 18 is not necessarily formed, and as illustrated in the left portion in FIG. 2, it is natural that the plurality of vertical heat-dissipation fins 12 adjacent to the guide boss 14 may also be formed integrally with the guide boss 14.

In an embodiment of the second heat-dissipation part 100 having the cutout part 18 formed therein, there is an advantage that independently dissipates the heat generated from the heat-generation element 51 to be heat-dissipated with the involvement of only the second heat-dissipation part 100. On the contrary, in an embodiment of the second heat-dissipation part 100 in which the cutout part 18 is not formed and the plurality of vertical heat-dissipation fins 12 of the first heat-dissipation part 10 are formed integrally with the guide boss 14, there is an advantage that appropriately distributes the heat generated from the heat-generation element 51 to the first heat-dissipation part 10 and the second heat-dissipation part 100 via the guide boss 14, thereby enabling rapid heat dissipation.

Further, one surface on which the heat-generation element 51 has been mounted is accommodated and coupled to face the inside of the through hole 13 in the PCB accommodation space 5 of the heat-dissipation part housing 11 corresponding to the lower side in the figure. At this time, at least a portion of the heat-generation element 51 is preferably disposed to overlap the inside of the through hole 13.

A plurality of fastening flanges 15 to which the second heat-dissipation part 100 may be screw-coupled by a fastening screw 114 may be provided to be protruded toward the center of the through hole 13 on the lower end portion of the inner circumferential surface of the through hole 13.

A screw through hole 16 to which the fastening screw 114 is fastened may be perforated and formed vertically in the plurality of fastening flanges 15. Further, a fastening groove 17 in which a head portion 114*b* of the fastening screw 114 is accommodated may be formed to be opened downwards on the lower surface of the plurality of fastening flanges 15 (see the reference numerals in FIGS. 4 and 5).

Meanwhile, a preferred embodiment of the MIMO antenna apparatus 1 according to the present disclosure, as illustrated in FIG. 2, may further include a cover panel 40 coupled to shield the opened one surface of the heat-dissipation part housing 11. The cover panel 40 is a configuration of serving as protecting the PCB 50 coupled to the inside of the PCB accommodation space 5 from the outside, and the coupling method to the heat-dissipation part housing 11 may be any method. The cover panel 40 may have a configuration corresponding to a radome for protecting the antenna elements if the above-described MIMO system is applied.

Figure 3:
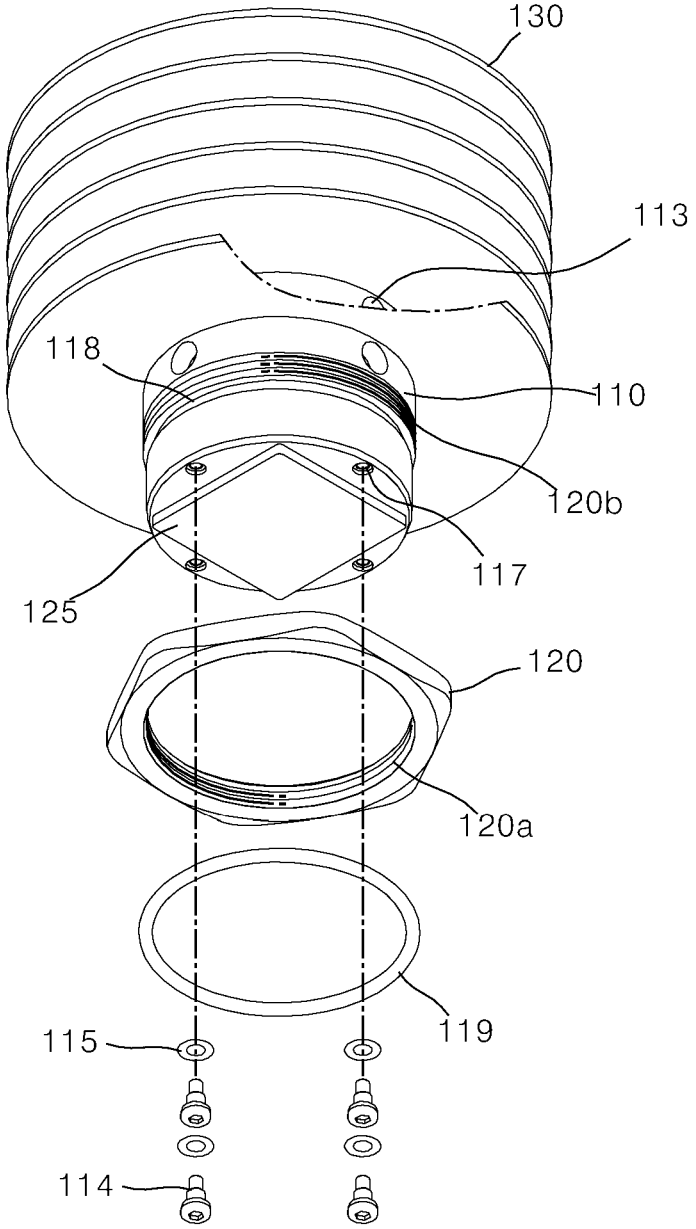
FIG. 3 is an exploded perspective diagram illustrating a second heat-dissipation part in the configuration in FIG. 1.
Figure 4:
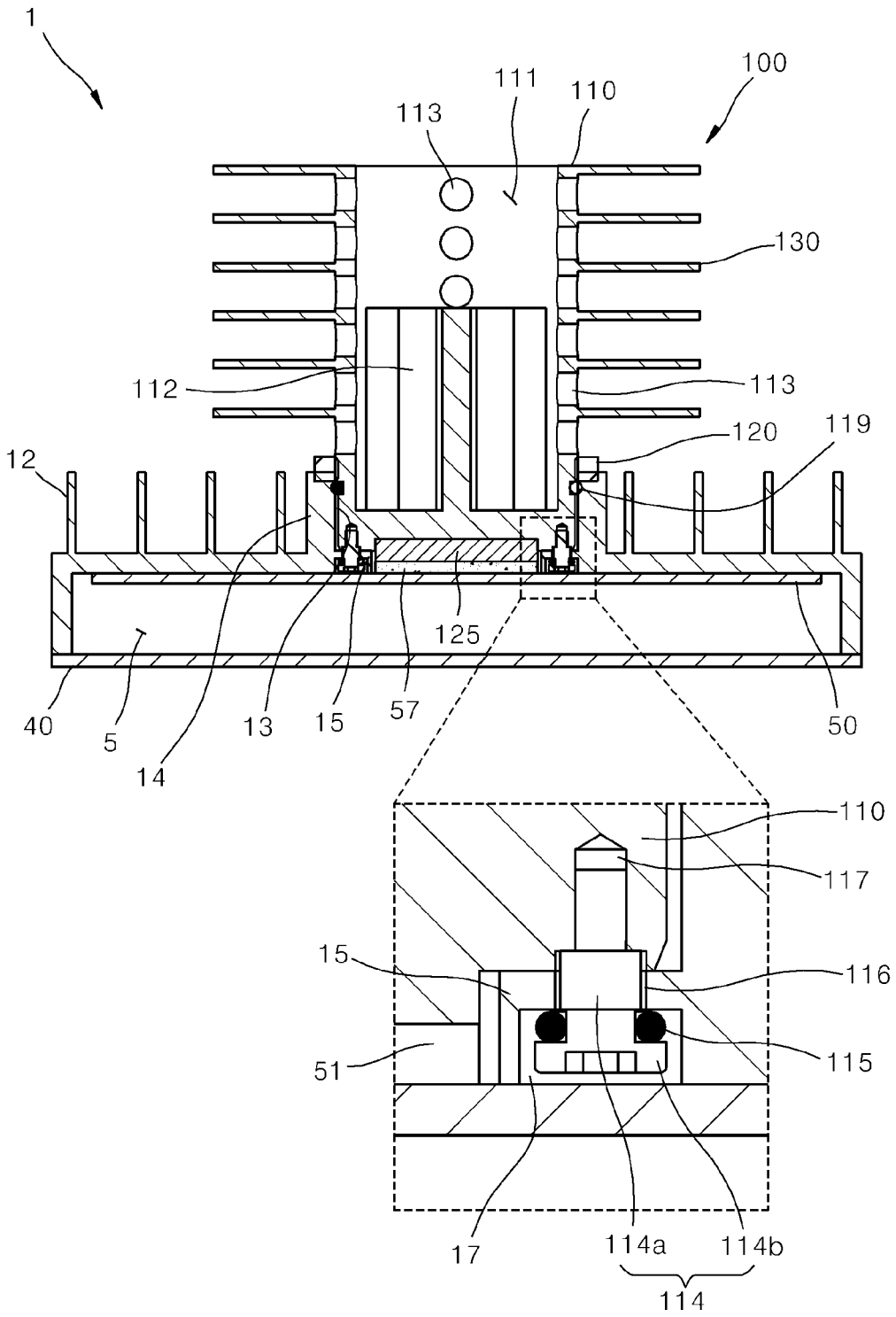
FIG. 4 is a cross-sectional diagram taken along the line A-A in FIG. 1.
Figure 5:
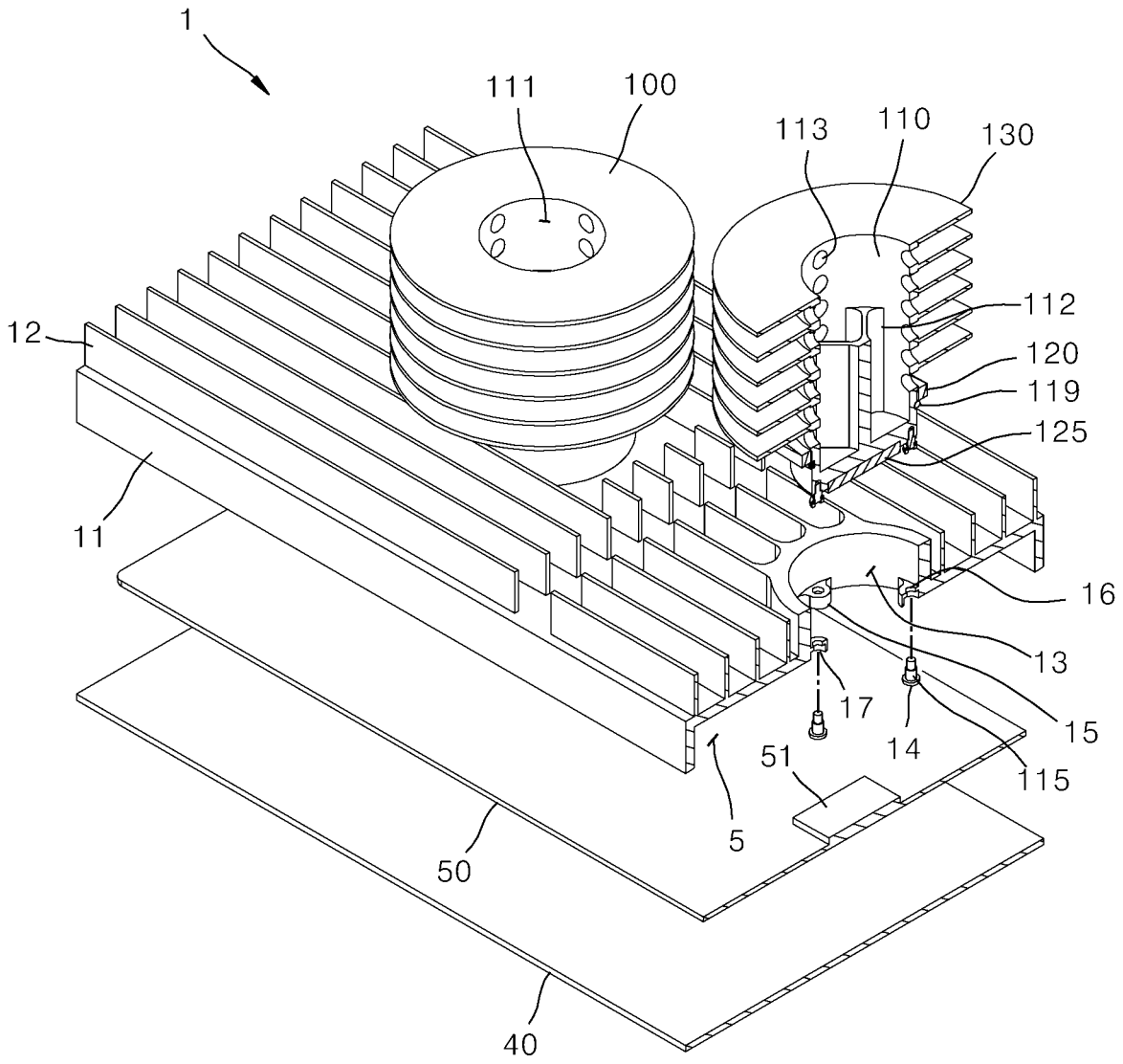
FIG. 5 is a cutout perspective diagram of the exploded state illustrating the coupling structure of the second heat-dissipation part to a PCB in the configuration in FIG. 4.

FIG. 3 is an exploded perspective diagram illustrating a second heat-dissipation part in the configuration in FIG. 1, FIG. 4 is a cross-sectional diagram taken along the line A-A in FIG. 1, and FIG. 5 is a cutout perspective diagram of the exploded state illustrating the coupling structure of the second heat-dissipation part to the PCB in the configuration in FIG. 4.

In a preferred embodiment of the MIMO antenna apparatus 1 according to the present disclosure, as illustrated in FIGS. 1 and 2, the second heat-dissipation part 100 is coupled to the through hole 13 formed in the heat-dissipation part housing 11 to accommodate the lower end portion thereof.

As illustrated in FIGS. 3 to 5, the second heat-dissipation part 100 may include a coupling body 110 coupled to the through hole 13 formed in the heat-dissipation part housing 11 to accommodate one end portion (the lower end portion in the figure) thereof, and a plurality of horizontal heat-dissipation fins 130 extended and formed to be perpendicular to the above-described plurality of vertical heat-dissipation fins 12 on the outer circumferential surface of the coupling body 110.

More specifically, the coupling body 110 is formed to have a cylindrical shape having a diameter of the size that may be inserted into the through hole 13, and the plurality of horizontal heat-dissipation fins 130 may be formed to have a panel shape radially extending from the outer circumferential surface of the coupling body 110, and disposed in multiple stages to be spaced at a predetermined distance apart from each other vertically.

As illustrated in FIGS. 3 to 5, a heat distribution space 111 axially cut toward the lower end portion thereof may be formed on the other end portion (the upper end portion in the figure) of the coupling body 110.

The heat distribution space 111 is a space prepared to be evenly distributed along the outer circumferential surface of the coupling body 110 by reducing the vertical thickness of the lower end portion of the coupling body 110, which is a portion that receives and delivers heat substantially. That is, the coupling body 110 is made of a material capable of heat conduction, but if the position where the heat distribution space 111 is formed has been fully filled, there is a possibility that non-uniformity of the heat delivery amount due to the thickness may occur. Here, if the heat generated from the heat-generation element 51 is delivered to the lower end portion of the coupling body 110, the heat distribution space 111 serves as conducting it to the outer circumferential surface of the coupling body 110 provided with the plurality of horizontal heat-dissipation fins 130 quickly and evenly.

However, since the heat may be agglomerated in an insulated state by the empty space, which is the heat dissipation space 111, in a preferred embodiment of the MIMO antenna apparatus 1 according to the present disclosure, as illustrated in FIGS. 3 to 5, a heat distribution bridge 112 extending a predetermined length upwards from the lower surface thereof, and having the horizontal cross section of a cross (+) shape may be further formed on the inner surface of the heat distribution space 111. Preferably, the heat distribution bridge 112 may be formed to extend upwards from the lower surface of the heat distribution space 111 to the intermediate portion thereof.

The heat distribution bridge 112 quickly conducts the heat agglomerated in the heat distribution space 111 and the heat directly delivered from the lower end portion of the coupling body 110 to the upper side of the outer circumferential surface of the coupling body 110 provided with the plurality of horizontal heat-dissipation fins 130.

Meanwhile, as illustrated in FIGS. 3 to 5, a plurality of air vent holes 113 for communicating the heat distribution space 111 with the outside may be formed in the coupling body 110.

More specifically, the plurality of air vent holes 113 may be formed to be arranged in a straight line upwards from the inner wall surfaces of the four spaces partitioned by the heat distribution bridge 112 of the cross '+' shape in the heat distribution space 111, respectively.

Preferably, since the plurality of horizontal heat-dissipation fins 130 are vertically provided at the outside of the coupling body 110 as described above, it is preferable that the plurality of air vent holes 113 are formed to be penetrated between the plurality of horizontal heat-dissipation fins 130.

The plurality of air vent holes 113 serve as having uniform heat-dissipation performance by discharging the heat aggregated in the heat distribution space 111 to the outside corresponding to each layer formed by the plurality of horizontal heat-dissipation fins 130. That is, the plurality of air vent holes 113 may prevent the delivered heat from being agglomerated or eccentrically dissipated by smoothly circulating the air in the heat distribution space 111.

Meanwhile, an element contact surface is formed to be protruded by a predetermined length toward the heat-generation element 51 on one surface (that is, the lower surface forming the lower end portion of the coupling body 110 in the figure) forming one end portion of the coupling body 110.

As illustrated in FIGS. 2 and 3, the element contact surface may be formed to have the appearance of a shape corresponding to the upper surface of the heat-generation element that is substantially in contact, and may be preferably formed to have a shape capable of directly contacting the heat-generation element 51 provided on the lower portion thereof without interfering with the plurality of fastening flanges 15 formed in the through hole 13.

The element contact surface may also be molded integrally with the coupling body 110 as the same material having the same thermal conductivity as the coupling body 110, but may also be provided as a heat conductive medium block 125 to be described later. This will be described later in detail.

Meanwhile, a plurality of screw fastening holes 117 may be formed on the rim portion of the lower surface of the coupling body 110 corresponding to the remainder except for the element contact surface. The plurality of screw fastening holes 117 are preferably formed so that the fastening screw 114 is fastened from the lower side to the upper side in the figure. Although it has been limitedly described in a preferred embodiment of the present disclosure that the shape of the element contact surface described above is adopted as a square shape, and the plurality of screw fastening holes 117, that is, four ones are formed by one at the outside of each surface of the element contact surface of the square shape, the present disclosure is not limited thereto.

Since the fastening screw 114 is provided to be fastened to the lower side in the figure, the coupling body 110 has one surface moved to the side at which the heat-generation element 51 has been provided upon the coupling with the coupling screw 114.

The plurality of screw fastening holes 117 may move the coupling body 110 from the upper side to the lower side of the through hole 13 to match with a screw through hole 16 formed on the plurality of fastening flanges 15 and then screw-couple it by using the fastening screw 114 to primarily fix the coupling body 110 to the heat-dissipation part housing 11.

However, a predetermined assembling tolerance necessary for coupling the coupling body 110 to the through hole 13 of the heat-dissipation part housing 11 should be considered upon the design of the product, while there is the possibility in which the height deviation, and the like occurs when mounting the heat-generation element 51 on one surface of the PCB 50 in a method such as the soldering method.

Here, the upper surface of the heat-generation element 51 and the lower surface of the coupling body 110 of the second heat-dissipation part 100 for directly dissipating the heat may implement optimum heat-dissipation performance only when they directly contact each other, but there is a problem in that a gap occurs or a direct contact coupling is not easy due to the above-described assembling tolerance, height deviation, and the like even after the coupling by the fastening screw 114 has been completed.

In order to solve such a problem, in a preferred embodiment of the MIMO antenna apparatus 1 according to the present disclosure, a tolerance absorption ring 115, which closely contacts the plurality of fastening flanges 15 by the head portion 114*b* of the fastening screw 114, respectively, upon the coupling of the fastening screw 114, and is elastically deformed by the coupling force generated upon the coupling of the PCB 50 to the heat-dissipation part housing 11, may be interposed on the outer circumferential surface of the fastening screw 114.

More specifically, the fastening screw 114 is composed of a body 114*a* having a male thread formed thereon, and the head portion 114*b* formed at the front end of the body 114*a* and having a tool groove of a cross (+) or a straight (−) shape, into which a fastening tool such as a driver is fitted, formed thereon.

Here, the tolerance absorption ring 115 is fitted to the outer circumferential surface of the body 114*a*, the upper end of the tolerance absorption ring 115 upon the coupling of the fastening screw 114 to the plurality of fastening flanges 15 is supported by the inner surface of the fastening groove 17 of the fastening flange 15 in which the head portion 114*b* is accommodated and the lower end of the tolerance absorption ring 115 is supported by the head portion 114*b*.

The tolerance absorption ring 115 thus coupled maintains the state elastically deformed by the coupling force of the fastening member in a state where the upper surface of the heat-generation element 51 and the element contact surface of the coupling body 110 have contacted when coupling the PCB 50, on which the heat-generation element 51 has been mounted, to the inside surface of the PCB accommodation space 5 by using a fastening member not illustrated.

Then, even after the coupling of the PCB 50 has been completed by the permanent restoring force of the tolerance absorption ring 115, a mutual forcibly pressing force is formed between the element contact surface of the coupling body 110 and the upper surface of the heat-generation element 51. Here, the permanent restoring force of the tolerance absorption ring 115 refers to an inherent force that restores the deformed shape again due to the material characteristics if the external force is removed after a shape has been deformed if an external force is provided because its material is an elastic material such as rubber.

Formation of such a forcibly pressing force may prevent the mutual separation phenomenon between the element contact surface of the coupling body 110 and the upper surface of the heat-generation element 51, thereby greatly enhancing heat-dissipation performance.

Further, since the precise design of the product according to the assembling tolerance, the height deviation, and the like is not required, it is possible to enhance universality of the product.

However, the coupling body 110 is not necessarily coupled in such a manner as to be coupled to the through hole 13 of the heat-dissipation part housing 11 by the fastening screw 114 as described above.

That is, referring to the left side in the figure of FIG. 2, a male thread is formed on the outer circumferential surface of the lower end portion of the coupling body 110, and a female thread corresponding to the male thread may be processed and formed on the inner circumferential surface of the through hole 13 so that the coupling body 110 is screw-coupled.

However, in this case, the fastening flange 15 that may eliminate the assembling tolerance, the height deviation, and the like, instead of the easy coupling of the second heat-dissipation part 100 to the first heat-dissipation part 10, is not provided in the through hole 13, thereby degrading heat-dissipation performance and universality, but this may be eliminated by a locking ring 120 and a sealing member 119 to be described later.

More specifically, as illustrated in FIGS. 3 to 5, a sealing installation groove 118 is formed to have a groove shape on the outer circumferential surface of the coupling body 110 corresponding to the lower portion of the plurality of horizontal heat-dissipation fins 130, and a sealing member 119 is interposed in the sealing installation groove 118.

The sealing member 119 serves as blocking a gap between the inner circumferential surface of the upper end portion of the guide boss 14 and the outer circumferential surface of the coupling body 110 upon the coupling of the coupling body 110 to the through hole 13.

Meanwhile, the locking ring 120 is screw-coupled to the outer circumferential surface of the coupling body 110 corresponding to the upper portion of the sealing installation groove 118. To this end, a female thread 120*a* may be formed on the inner circumferential surface of the locking ring 120, and a male thread 120*b* may be formed on a corresponding portion where the locking ring 120 is installed in the outer circumferential surface of the coupling body 110.

The outer circumferential surface of the locking ring 120 is preferably formed to have a horizontal cross section of a polygonal shape so that an assembler may rotate by using an assembly tool such as a spanner.

The locking ring 120 is rotatably assembled so that the lower end of the locking ring 120 closely contacts the upper end of the guide boss 14 by using the assembly tool such as the above-described spanner, after the lower end portion of the coupling body 110 has been coupled to the fastening flange 15 of the through hole 13 in a state pre-coupled to the outer circumferential surface of the coupling body 110 with the margin in advance.

At this time, the coupling body 110 may be coupled to be supported by the fastening flange 15 primarily by the fastening screw 114 on the lower side of the through-hole 13, and coupled to be supported by the front end of the guide boss 14 secondarily by the locking ring 120 at the upper side of the through hole 13, thereby being firmly fixed to the first heat-dissipation part 10.

Further, when the lower end of the locking ring 120 is rotatably coupled to closely contact the front end of the guide boss 14, it may press the sealing member 119, thereby performing the same function as that of the above-described tolerance absorption ring 115 while the sealing member 119 is elastically deformed.

For example, regardless of the coupling method of the coupling body 110 to the through hole 13, once the sealing member 119 is elastically deformed by rotatably adjusting the locking ring 120 in a state where the element contact surface of the coupling body 110 has contacted the upper surface of the heat-generation element 51 of the PCB 50, the forcibly pressing force such as the tolerance absorption ring 115 is continuously formed between the element contact surface of the coupling body 110 and the upper surface of the heat-generation element 51 by the sealing member 119.

Accordingly, the sealing member 119 performs the sealing function of blocking the inflow of foreign substances such as moisture in a direction in which the PCB 50 has been provided through the through hole 13 from the outside while performing the same function as that of the tolerance absorption ring 115.

Meanwhile, in a preferred embodiment of the MIMO antenna apparatus 1 according to the present disclosure, as illustrated in FIG. 4, the second heat-dissipation part 100 may further include the heat conductive medium block 125 coupled to one surface (the lower surface) of the coupling body 110, and contacting one surface (the upper surface) of the heat-generation element 51.

The heat conductive medium block 125 is preferably made of a material having a higher thermal conductivity than that of the coupling body 110. That is, the element contact surface of the coupling body 110 may be replaced with the heat conductive medium block 125 having a high thermal conductivity.

In a preferred embodiment of the MIMO antenna apparatus 1 according to the present disclosure, the thermal conductivity of the coupling body 110 is provided to have its own heat-dissipation performance, but a preferred embodiment may allow the lower surface of the heat conductive medium block 125 having a higher thermal conductivity than the thermal conductivity of the coupling body 110 to serve as the element contact surface, thereby further enhancing heat-dissipation performance.

Here, the heat conductive medium block 125 may be coupled to the coupling groove formed in the groove shape on the lower surface of the coupling body 110 by any one method of a screw coupling method and a forcibly press-fitting method.

However, the method in which the coupling body 110 of the heat conductive medium block 125 is provided is not limited to the above-described methods. That is, the heat conductive medium block 125 may be coupled to the lower surface of the coupling body 110 in any one method of a bonding coupling method, a brazing coupling method, and a heterogeneous injection molding method so that the lower surface of the heat conductive medium block 125 is exposed.

Further, a thermally conductive medium material may be applied to the element contact surface, which is the lower surface of the coupling body 110 contacting the heat-generation element 51 or the lower surface of the heat conductive medium block 125.

The thermally conductive medium material is preferably applied to the element contact surface or the lower surface of the heat conductive medium block 125 in the sprayed form.

Figure 6:
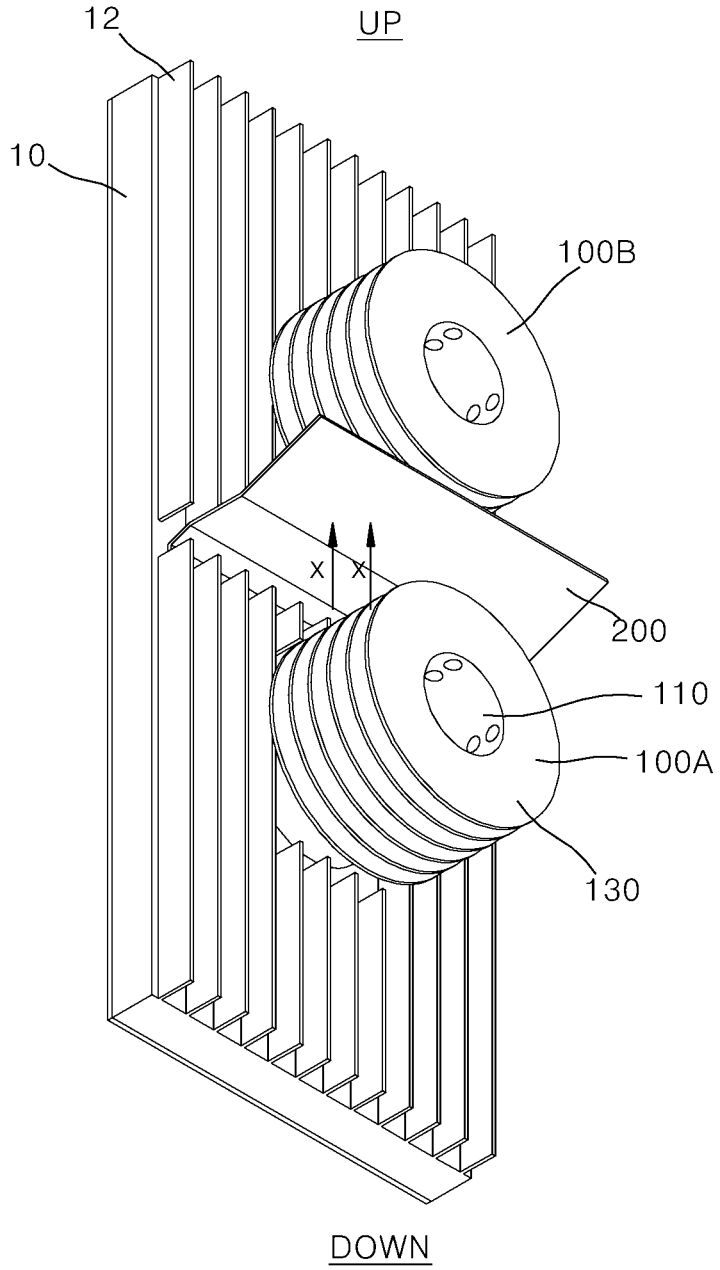
FIG. 6 is a perspective diagram illustrating an air baffle in the configuration in FIG. 1.

FIG. 6 is a perspective diagram illustrating an air baffle in the configuration in FIG. 1, and FIGS. 7A to 7C are perspective diagrams illustrating various forms of the second heat-dissipation part in the configuration of the MIMO antenna apparatus according to the present disclosure.

As illustrated in FIG. 6, a preferred embodiment of the MIMO antenna apparatus 1 according to the present disclosure may include an air baffle 200 disposed to partition between two second heat-dissipation parts 100 if at least two second heat dissipating parts 100 are disposed at the upper side and the lower side by one or by one or more, respectively, on one surface of the heat-dissipation part housing 11 disposed vertically.

As illustrated in FIG. 4, since the air baffle 200 may implement the non-uniform heat-dissipation performance for each second heat-dissipation part 100 if the heat dissipated by the second heat-dissipation parts 100A, 100B provided at the lower side relatively is delivered by the rising airflow to the second heat-dissipation part 100 provided at the upper side relatively according to the natural convection, the air baffle 200 serves as blocking the rising airflow of the lower side, thereby implementing overall uniform heat-dissipation performance.

The air baffle 200 may be provided to have the front end portion inclined upwards and accordingly, provided so that the heat dissipated from the horizontal heat-dissipation fin 130 of the second heat-dissipation part 100 of the lower side bypasses the second heat-dissipation part 100 of the upper side to be moved upwards without being stagnated by the air baffle 200.

Figure 7A:
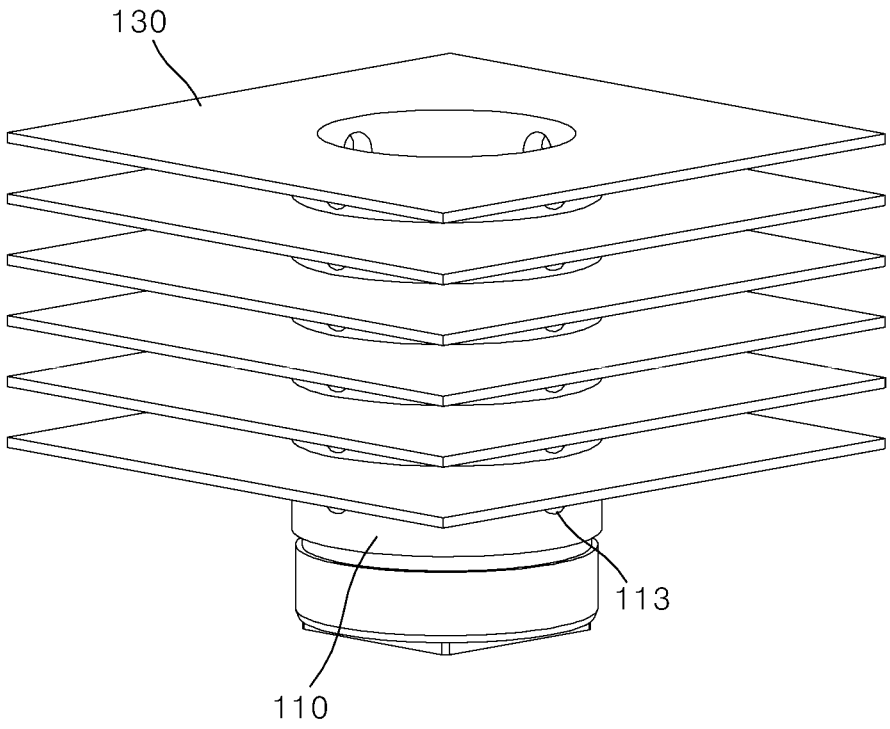
FIGS. 7A to 7C are perspective diagrams illustrating various forms of the second heat-dissipation part in the configuration of the MIMO antenna apparatus according to the present disclosure.
Figure 7B:
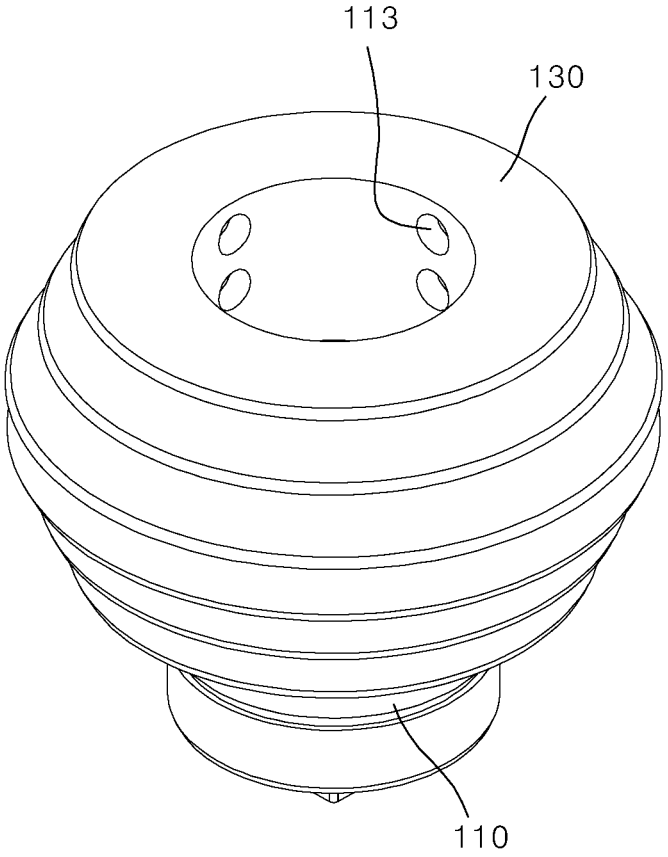
Figure 7C:
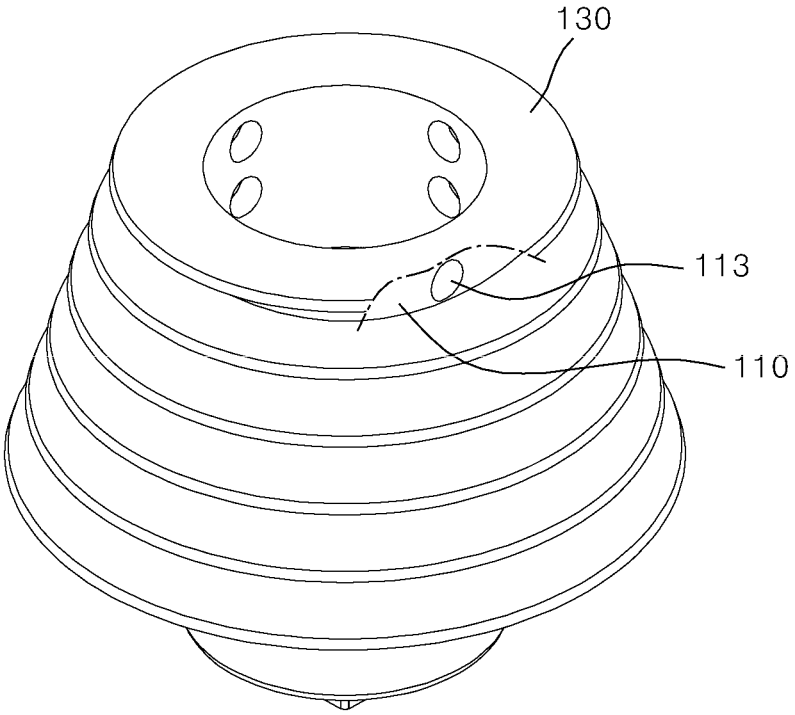

Meanwhile, the plurality of horizontal heat-dissipation fins 130 formed on the second heat-dissipation part 100 are arranged in multiple stages to be spaced at a predetermined distance apart from each other from the heat-generation element 51 to the outside (that is, the upper side in the figure of FIGS. 7A to 7C).

Here, the appearance combination of the plurality of horizontal heat-dissipation fins 130 may be formed to have a cylindrical shape with a diameter of each horizontal heat-dissipation fin 130 having a horizontal cross-sectional shape of the same circular shape as illustrated in FIGS. 1 to 6, a hexahedral shape with each horizontal heat-dissipation fin 130 having an area of the horizontal cross section of the same square as illustrated in FIG. 7A, a sphere shape having the circular horizontal cross section shape, having the largest diameter of the intermediate portion, and having a smaller area gradually upwards or downwards as illustrated in FIG. 7B, and a cone shape having the circular horizontal cross section shape and having a smaller area gradually upwards as illustrated in FIG. 7C.

Here, the hexahedral shape illustrated in FIG. 7A has a relatively simple structure and is easy to manufacture compared to the cylindrical shape illustrated in FIGS. 1 to 6. Further, in the case of the shape illustrated in FIG. 7C, since the heat-dissipation area of the horizontal heat-dissipation fin of the lower side, which is the most important for heat dissipation, should be wide, it is possible to have the wide effective heat-dissipation area of the horizontal heat-dissipation fin of the lowermost side, and to reduce the area of the horizontal heat-dissipation fin upwards, thereby reducing the overall weight.

Further, referring to FIGS. 7A to 7C, although only the embodiment in which the plurality of horizontal heat-dissipation fins 130 are stacked and disposed in 6 vertically to be spaced at a predetermined distance apart from each other are disclosed, the present disclosure is not necessarily limited thereto, and the number of the horizontal heat-dissipation fins 130 may be preferably designed differently considering the amount of heat generated by the heat-generation element 51, the interference relationship with the peripheral component, and the like.

Further, it is natural that the horizontal area of the plurality of horizontal heat-dissipation fins 130 may also be actively changed in design considering the amount of heat generated by the heat-generation element 51.

Comparing the operational relationship between the heat dissipation using the MIMO antenna apparatus 1 according to the present disclosure configured as described above and the heat dissipation according to the conventional method is as follows.

Figure 8A:
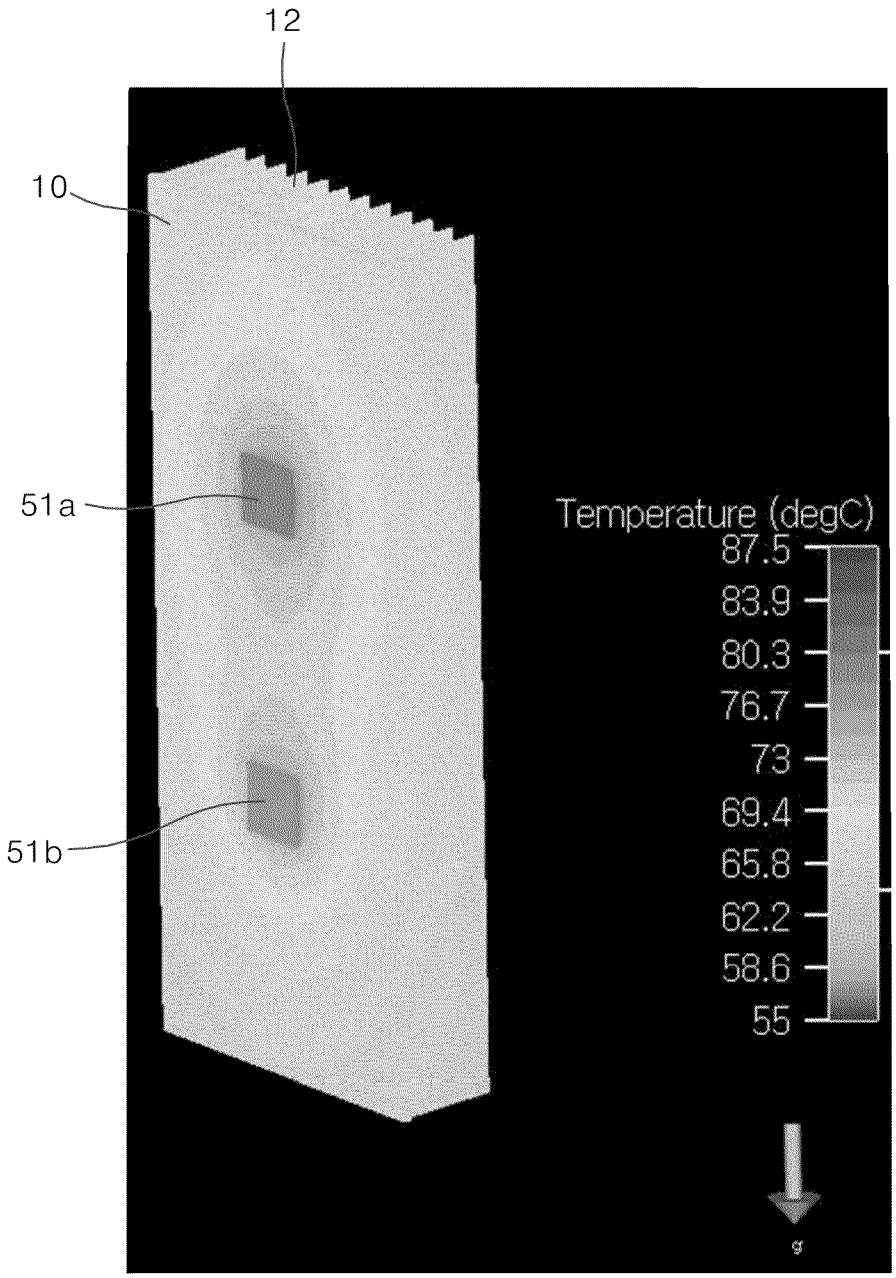
FIGS. 8A and 8B are heat distribution diagrams for comparing the heat-dissipation performance between the conventional heat-dissipation mechanism and the MIMO antenna apparatus according to the present disclosure.
Figure 8B:
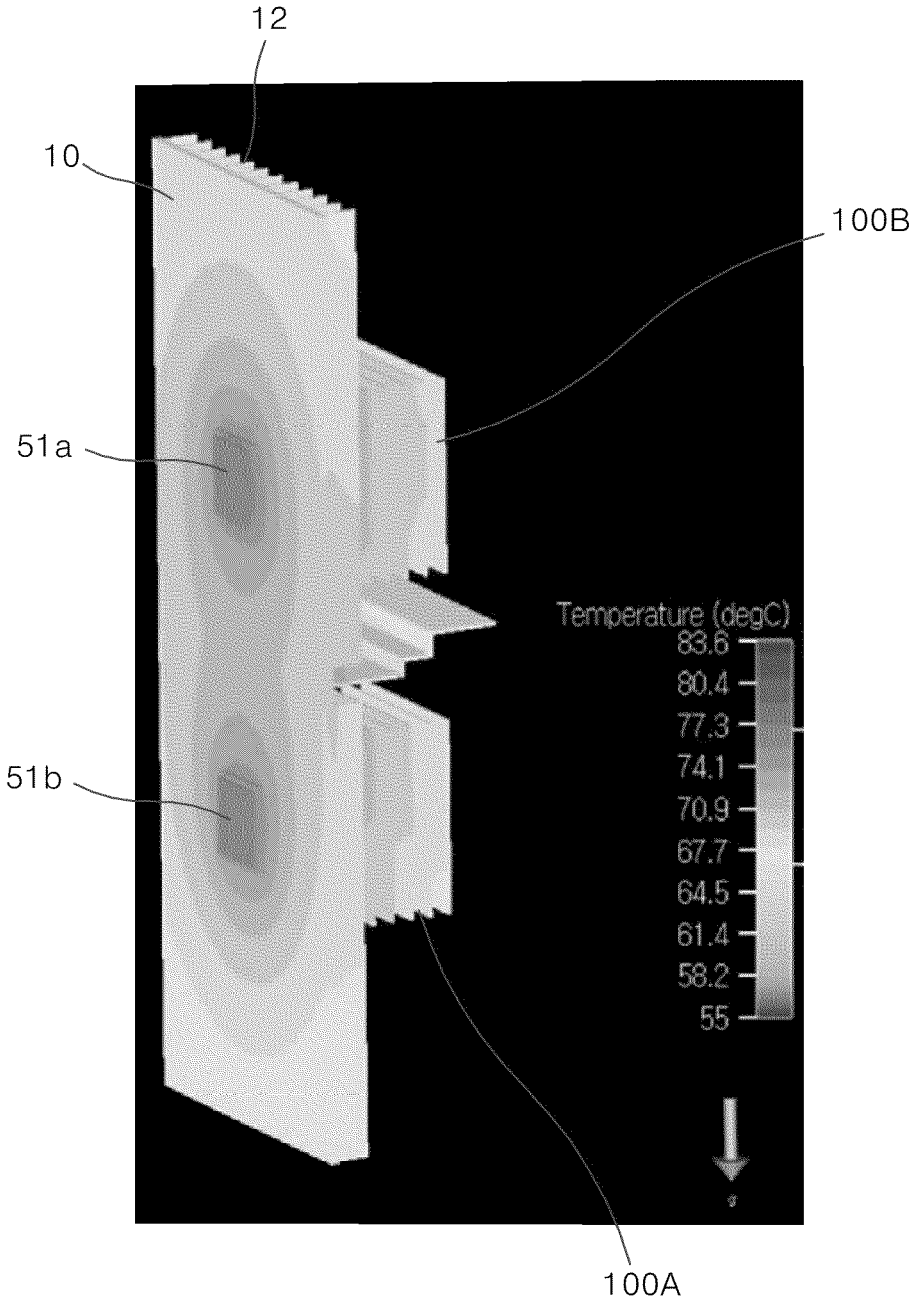

FIGS. 8A and 8B are heat distribution diagrams for comparing the heat-dissipation performance of the conventional heat-dissipation mechanism and the MIMO antenna apparatus 1 according to the present disclosure.

The applicant of the present disclosure adopted the first heat-dissipation part 10 having the following common specification so that a common environment is constructed in order to obtain the most objective comparison data.

That is, the area of one surface of the heat-dissipation part housing 11 of the first heat-dissipation part 10 was 500×200×81 mm, the thickness of the heat-dissipation part housing 11 except for the plurality of vertical heat-dissipation fins 12 was 5.0 mm, the height of the plurality of the vertical heat-dissipation fins 12 was 60 mm, and the number of the plurality of vertical heat-dissipation fins 12 was 12 in common.

Further, the second heat-dissipation part 100 was vertically disposed in the first heat-dissipation part 10 so that two heat sources are vertically disposed to be spaced at a predetermined distance apart from each other vertically, and the cooling method applied a Natural Convection Cooling Type in which forced air is not involved at all.

As a result of performing the experiment under the same conditions as described above, as illustrated in FIG. 8A, upon the heat dissipation by the conventional method, the highest temperature of a first heat source 51*a* positioned at the upper side of the heat-generation elements 51 reached 87.5° C., while the highest temperature of a second heat source 51*b* positioned at the lower side of the heat-generation element 51 also reached 86.3° C., but it was confirmed that as illustrated in FIG. 8B, upon the heat dissipation through the MIMO antenna apparatus 1 according to a preferred embodiment of the present disclosure, the highest temperature of the first heat source 51*a* positioned at the upper side of the heat-generation element 51 was reduced to 83.6° C., while the highest temperature of the second heat source positioned at the lower side of the heat-generation element 51 was also reduced to 83.1° C.

That is, a preferred embodiment of the MIMO antenna apparatus 1 according to the present disclosure derived the temperature improvement effect of 3.8° C. based on the first heat source 51*a*, and it was confirmed that in order to overcome the temperature difference through the conventional method, the height of the plurality of vertical heat-dissipation fins 12 should be further increased by 60 mm, which disproves that miniaturization of the product size is immediately possible.

Further, it was confirmed that according to the conventional method, the temperature deviation for each of the first heat source 51*a* and the second heat source 51*b* is 1.2° C., but upon the application of the MIMO antenna apparatus 1 according to a preferred embodiment of the present disclosure, since the temperature deviation is only 0.5°, it is possible to reduce the heat-dissipation performance for each heat source by the air baffle 200, thereby implementing better heat-dissipation performance.

Accordingly, according to a preferred embodiment of the MIMO antenna apparatus 1 according to the present disclosure that is provided so that the lower surface of the coupling body 110 directly contacts the upper surface of the heat-generation element 51, it is possible to implement excellent heat-dissipation performance compared to the conventional method attempting the heat dissipation through the medium configuration such as a thermal pad.

As described above, a preferred embodiment of the MIMO antenna apparatus according to the present disclosure has been described in detail with reference to the accompanying drawings. However, the embodiment of the present disclosure is not necessarily limited to the above-described preferred embodiment, and it is natural that various modifications and equivalents thereof may be made by those skilled in the art to which the present disclosure pertains. Accordingly, the true scope of the present disclosure will be determined by the claims to be described later.

INDUSTRIAL APPLICABILITY

According to the present disclosure, it is possible to manufacture the MIMO antenna apparatus, which may directly contact the heat-dissipation part to the heat-generation elements to significantly reduce the contact thermal resistance generated during the heat delivery, thereby enhancing heat-dissipation performance and increasing the apparatus lifespan, and to eliminate the assembling tolerance and the height deviation with the peripheral component, thereby enhancing universality.

The invention claimed is:

1. An MIMO antenna apparatus, comprising:

a Printed Circuit Board (PCB) having a heat-generation element provided on a surface thereof;

a first heat-dissipation part disposed to cover the surface of the PCB, wherein the first heat-dissipation part comprises a lower surface having a through hole formed at a portion corresponding to a position of the heat-generation element of the PCB, wherein the first heat-dissipation part further comprises a plurality of vertical heat-dissipation fins formed to protrude from an upper surface of the first heat-dissipation part in a direction perpendicular to the upper surface of the first heat-dissipation part; and a second heat-dissipation part detachably coupled to the through hole to contact a surface of the heat-generation element to receive heat from the heat-generation element and to dissipate heat, wherein the second heat-dissipation part comprises a coupling body which has one end coupled to be accommodated in the through hole and a plurality of horizontal heat-dissipation fins protruding horizontally from an outer circumferential surface of the coupling body.

2. The MIMO antenna apparatus of claim 1, wherein each of the plurality of horizontal heat-dissipation fins is formed on the outer circumferential surface of the coupling body to extend perpendicular to the plurality of vertical heat-dissipation fins.

3. The MIMO antenna apparatus of claim 2, wherein the plurality of horizontal heat-dissipation fins are arranged in plural in multiple stages to be spaced at a predetermined distance apart from each other from the heat-generation element externally, and wherein the plurality of horizontal heat-dissipation fins is are formed to have any one among cylindrical, hexahedral, sphere, and cone shapes.

4. The MIMO antenna apparatus of claim 1, wherein a heat distribution space cut axially toward one end thereof is formed on another end of the coupling body, and wherein a heat distribution bridge extending upwards from a bottom surface of the heat distribution space and having a horizontal cross section of a "+" shape is formed inside the heat distribution space.

5. The MIMO antenna apparatus of claim 1, wherein the coupled body is formed with a plurality air vent holes which allow the heat distribution space to communicate externally, and wherein the plurality of air vent holes are provided alternately between the plurality of horizontal heat-dissipation fins.

6. The MIMO antenna apparatus of claim 1, wherein a plurality of screw fastening holes are formed on a rim portion of one surface forming the one end of the coupling body, wherein the through hole is provided with a plurality of fastening flanges protruding into the through hole, wherein each of the plurality of fastening flanges has a screw through hole formed therein, and wherein the coupling body is screw-coupled to the plurality of fastening flanges by a fastening screws.

7. The MIMO antenna apparatus of claim 6, wherein a bottom surface of the one end of the coupling body is in contact with the surface of the heat-generation element upon coupling of the fastening screws to the plurality of fastening flanges.

8. The MIMO antenna apparatus of claim 6, wherein a tolerance absorption ring tightly contacting the plurality of fastening flanges, respectively, by a head of each of the fastening screws upon the coupling of the fastening screws is interposed on an outer circumferential surface of each of the fastening screws.

9. The MIMO antenna apparatus of claim 8, wherein the tolerance absorption ring is made of an elastic material.

10. The MIMO antenna apparatus of claim 8, wherein the PCB is coupled to the first heat-dissipation part by a fastening member so that the heat-generation element faces the through hole, and wherein the tolerance absorption ring is elastically deformable in response to an application of a coupling force of the PCB to the first heat-dissipation part by the fastening member.

11. The MIMO antenna apparatus of claim 1, wherein a female thread is formed on an inner circumferential surface of the through hole, and a male thread is formed on the outer circumferential surface of the coupling body to allow the coupling body to be tightly coupled the through hole.

12. The MIMO antenna apparatus of claim 11, wherein a guide boss which extends the through hole to the outside and guides insertion of one end the coupling body is formed to protrude from another surface of the first heat-dissipation part having the plurality of vertical heat-dissipation fins formed thereon, and wherein a locking ring screw-coupled to tightly contact the front end of the guide boss is provided on the outer circumferential surface of the coupling body.

13. The MIMO antenna apparatus of claim 12, wherein a sealing member for blocking a gap between the inner circumferential surface of the guide boss and the coupling body is interposed on the outer circumferential surface of the coupling body, and wherein the locking ring presses the sealing member when closely contacting the front end of the guide boss.

14. The MIMO antenna apparatus of claim 1, wherein the second heat-dissipation part further comprises a heat conductive medium block provided on a bottom surface of the one end of the coupling body, and is in contact with the surface of the heat-generation element, and wherein the heat conductive medium block is made of a material having a higher thermal conductivity than that of the coupling body.

15. The MIMO antenna apparatus of claim 14, wherein the heat conductive medium block is coupled to a coupling groove formed in a groove shape on the bottom surface of the one end of the coupling body by any one method of a screw coupling method and a forcibly press-fitting method.

16. The MIMO antenna apparatus of claim 14, wherein the heat conductive medium block is coupled to the bottom surface of the one end of the coupling body by any one method among a bonding coupling method, a brazing coupling method, and a heterogeneous injection molding method.

17. The MIMO antenna apparatus of claim 14, wherein a heat conductive medium material is applied to the bottom surface of the one end of the coupling body which is in contact with the heat-generation element.

18. The MIMO antenna apparatus of claim 1, further comprising:

a third heat-dissipation part provided to contact a surface of another heat-generation element to receive heat from the another heat-generation element and to dissipate heat; and an air baffle for blocking the heat dissipated from the second heat-dissipation part from being delivered to the third heat-dissipation part.

* * * * *